US011910971B2

(12) United States Patent
Hoffman et al.

(10) Patent No.: US 11,910,971 B2
(45) Date of Patent: Feb. 27, 2024

(54) SURFACE CLEANER

(71) Applicant: Techtronic Floor Care Technology Limited, Tortola (VG)

(72) Inventors: Eric Hoffman, Schenectady, NY (US); Rafael Davila, Kannapolis, NC (US); Michael Dawson, Huntersville, NC (US); Daniel Galleno, Charlotte, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 18/259,793

(22) PCT Filed: Jan. 7, 2022

(86) PCT No.: PCT/US2022/011548

§ 371 (c)(1),
(2) Date: Jun. 29, 2023

(87) PCT Pub. No.: WO2022/150546

PCT Pub. Date: Jul. 14, 2022

(65) Prior Publication Data

US 2023/0389764 A1 Dec. 7, 2023

Related U.S. Application Data

(60) Provisional application No. 63/134,774, filed on Jan. 7, 2021.

(51) Int. Cl.
*A47L 11/20* (2006.01)
*A47L 11/40* (2006.01)

(52) U.S. Cl.
CPC ..... *A47L 11/201* (2013.01); *A47L 11/4016* (2013.01); *A47L 11/4083* (2013.01); *A47L 11/4088* (2013.01); *A47L 11/4075* (2013.01)

(58) Field of Classification Search
CPC ..... A47L 11/201; A47L 11/4088; A47L 11/4044; A47L 11/4083; A47L 11/4016; A47L 11/34; A47L 7/0004; A47L 11/4075; B08B 9/027; A62C 33/02
USPC ..... 15/320, 321
See application file for complete search history.

(56) References Cited

U.S. PATENT DOCUMENTS 10,588,476 B2 3/2020 Royale et al.
2013/0318741 A1 12/2013 Moyher, Jr. et al.

FOREIGN PATENT DOCUMENTS

EP 3466313 A1 4/2019

OTHER PUBLICATIONS

International Search Report and Written Opinion for Application No. PCT/US2022/011548 dated Jun. 21, 2022 (17 pages).

*Primary Examiner* — Don M Anderson
*Assistant Examiner* — Sarah Akyaa Fordjour
(74) *Attorney, Agent, or Firm* — Michael Best & Friedrich LLP

(57) ABSTRACT

A surface cleaner configured to distribute a liquid to a surface to be cleaned. The surface cleaner includes a supply tank, a fluid distributor, a suction inlet aperture, a recovery tank and a tool removably connectable to the surface cleaner and configured to direct fluid from the fluid distributor into the suction inlet aperture to rinse the suction inlet aperture.

17 Claims, 18 Drawing Sheets

SURFACE CLEANER

CROSS-REFERENCE TO RELATED APPLICATIONS

This application claims priority to U.S. Provisional Patent Application No. 63/134,774, filed Jan. 7, 2021, the entire contents of which are hereby incorporated by reference herein.

BACKGROUND

The present invention relates to surface cleaners, and more particularly, a wet surface cleaner with a tool configured to direct cleaning fluid through a suction inlet to rinse the suction inlet.

SUMMARY

In one embodiment a surface cleaner is disclosed including a supply tank configured to store a fluid, a fluid distributor in fluid communication with the supply tank, an actuator to selectively dispense fluid from the supply tank through the fluid distributor, a suction source, and a recovery tank. The surface cleaner further includes a duct having sidewalls forming a suction inlet aperture. The suction source is in fluid communication with the suction inlet aperture. The recovery tank is in fluid communication with the suction inlet aperture and the suction source, and the recovery tank is configured to receive the fluid and the suction airflow from the suction inlet aperture. A tool is selectively connectable to the surface cleaner and is configured to direct fluid from the supply tank to the duct for rinsing the duct. The tool has a housing forming a passageway. The housing has a passageway inlet configured to receive a portion of the fluid distributor and a passageway outlet. The passageway outlet is positionable within the suction inlet aperture when the passageway inlet receives a portion of the fluid distributor. The passageway outlet of the tool is spaced from the duct sidewall inside the suction inlet aperture enabling airflow into the suction inlet aperture sufficient to draw fluid into the duct when the actuator selectively dispenses fluid from the fluid dispenser into the passageway inlet.

In one embodiment a surface cleaner is disclosed including a suction source, a suction inlet, a supply tank, a fluid distributor, and a recovery tank. The supply tank is configured to store a fluid. The fluid distributor is in fluid communication with the supply tank. The surface cleaner includes an actuator to selectively dispense fluid from the supply tank through the fluid distributor. The suction inlet is in fluid communication with the suction source, and the recovery tank is in fluid communication with the suction inlet and the suction source. The recovery tank is configured to receive the fluid and the suction airflow from the suction inlet. A tool is selectively connectable to the fluid distributor. The tool is configured to direct fluid from the supply tank through the fluid distributor and into the suction inlet to rinse the suction inlet. The tool includes a housing with a fluid inlet configured to receive a portion of the fluid distributor and an outlet configured to direct fluid flow from the fluid inlet into the suction inlet and the fluid outlet covers less than 50% of the suction inlet.

In one embodiment a surface cleaner is disclosed including a supply tank configured to store a fluid, a fluid distributor in fluid communication with the supply tank, a suction source, a suction inlet in fluid communication with the suction source such that the suction inlet creates an airflow path along a suction duct to suction dispensed fluid and deposit the fluid into a recovery tank, and a cover portion adjacent the fluid distributor. The surface cleaner further includes an actuator to selectively dispense fluid from the supply tank through the fluid distributor. The cover portion includes an inlet aperture proximal the fluid distributor, an outlet aperture distal the fluid distributor, and a cover pathway connecting the inlet aperture and the outlet aperture. The outlet aperture is selectively alignable with the suction duct. The cover portion is movable between a first position in which the inlet aperture is spaced from the fluid distributor and the outlet aperture is not aligned with the suction duct, and a second position in which the inlet aperture is positioned over the fluid distributor and the outlet aperture is aligned with the suction duct. The cover portion is configured to direct fluid from the fluid distributor into the cover pathway and through the outlet aperture and into the suction duct.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

The present disclosure relates to a surface cleaner, specifically a wet surface cleaner with a fluid distributor in fluid communication with a supply tank, a suction inlet aperture, and a tool configured to direct fluid from the fluid distributor into the suction inlet aperture to flush the suction inlet aperture and a suction duct. In one embodiment, the tool is selectively connectable to the surface cleaner between a removed position and a connected position for rinsing the suction duct. A common occurrence in wet surface cleaners is debris contacting or coating the suction pathway during use. The current disclosure provides an effective, compact, and simple solution to help rinse the suction pathway by redirecting fluid from the fluid distributor into the suction inlet aperture and through the suction pathway.

Figure 1:
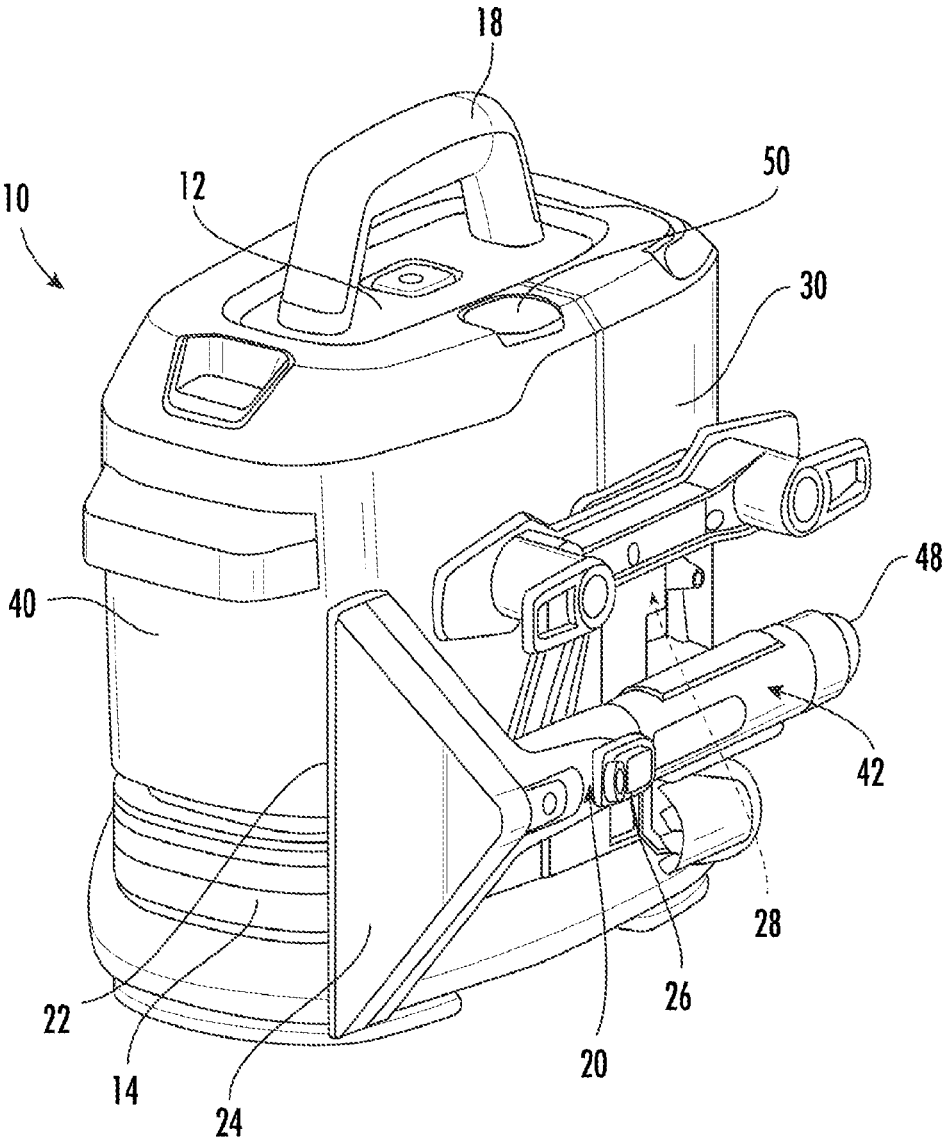
FIG. 1 is a perspective view of a surface cleaner according to one embodiment.
Figure 2:
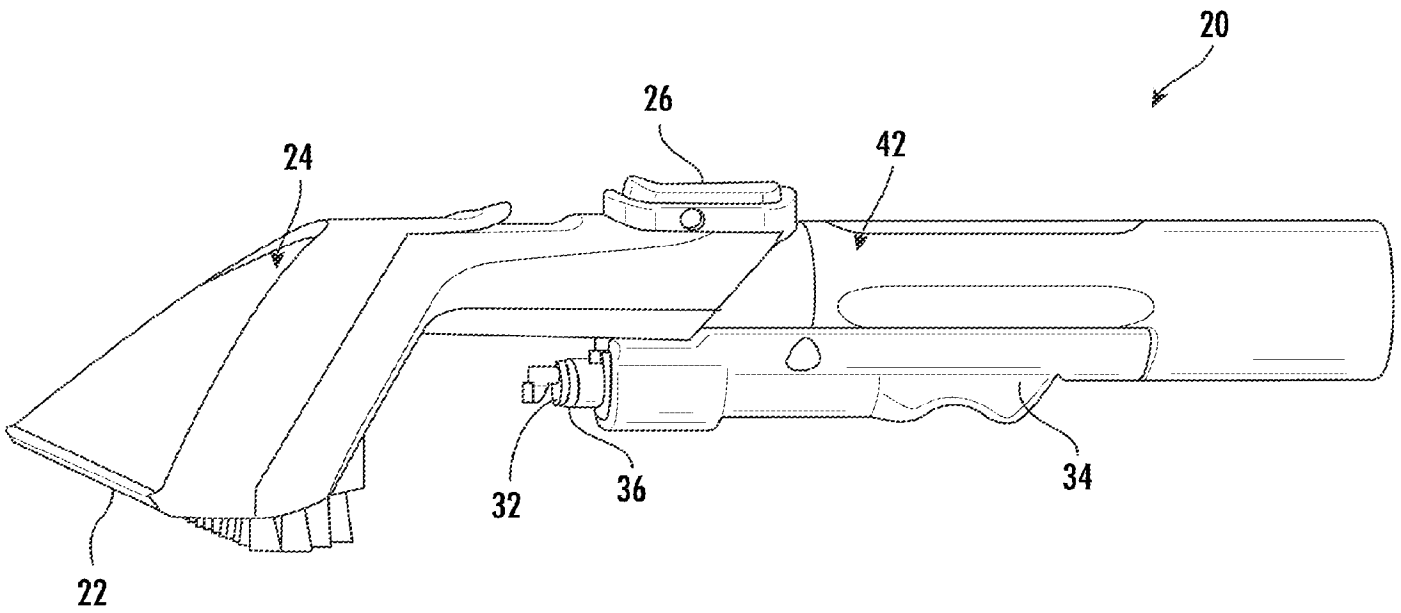
FIG. 2 is a side view of a cleaning accessory of the surface cleaner of FIG. 1.

FIG. 1 illustrates a perspective view of a surface cleaner 10 according to an embodiment of the invention. The surface cleaner 10 is a surface cleaner that delivers a liquid, such as a spot cleaner, carpet or hard floor extractor, or the like. The surface cleaner 10 has a main body 12 with a base 14 that supports the surface cleaner 10 on a surface to be cleaned. In the illustrated embodiment, the surface cleaner includes a handle 18 on the main body 12 graspable by the user. In one embodiment, the surface cleaner 10 includes a cleaning accessory 20 (shown in FIG. 1 in a stowed position) having a suction inlet 22 and a fluid distributor 32 (FIG. 2). The surface cleaner 10 includes a supply tank 30 configured to provide a cleaning liquid to the fluid distributor 32. A suction duct 42 is in fluid communication with a suction source 28 that generates a suction airflow path to draw air and debris and/or liquid through the suction inlet 22. A recovery tank 40 is in fluid communication with the suction duct 42 and the suction source 28. The recovery tank 40 contains debris and/or liquid collected through the suction inlet 22.

Figure 3:
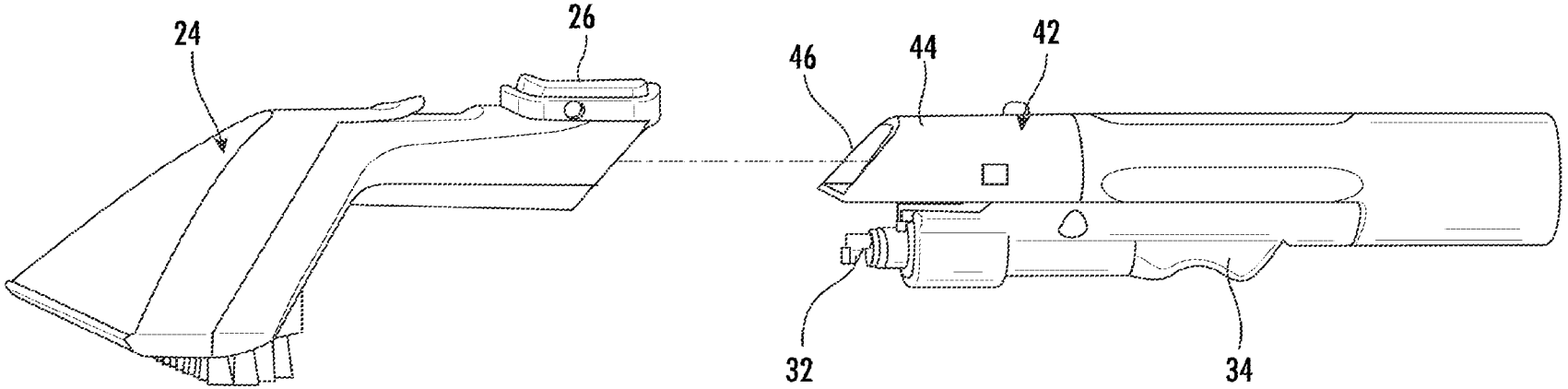
FIG. 3 is an exploded view of the cleaning accessory of FIG. 2.
Figure 4A:
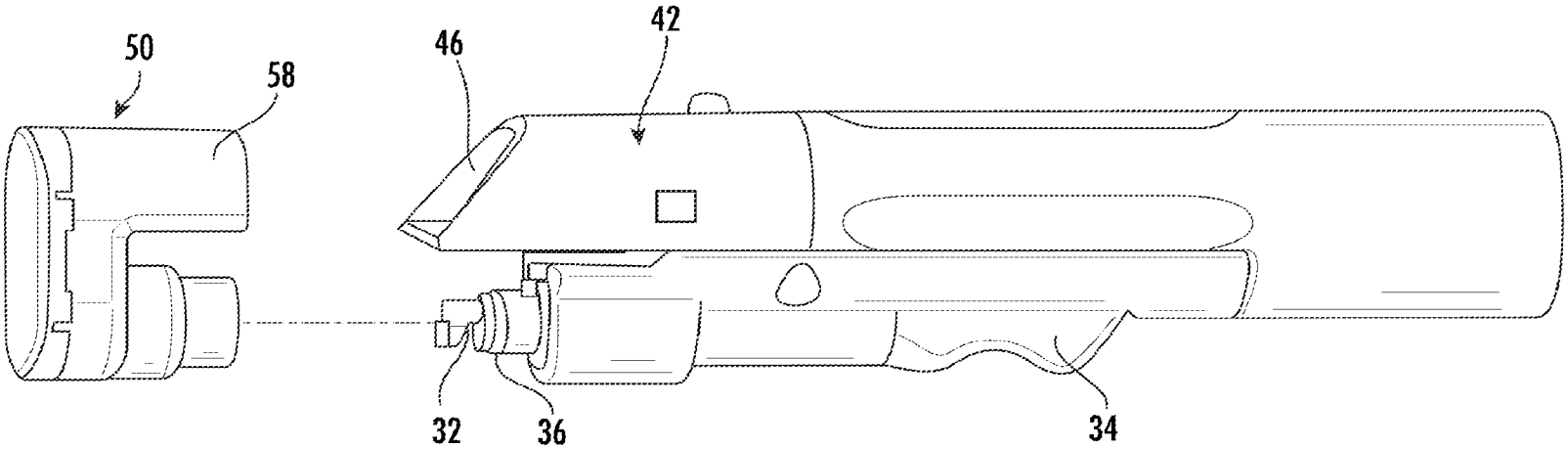
FIG. 4*a* is a side view of a cleaning accessory and a tool of the surface cleaner of FIG. 1, according to one embodiment.
Figure 4B:
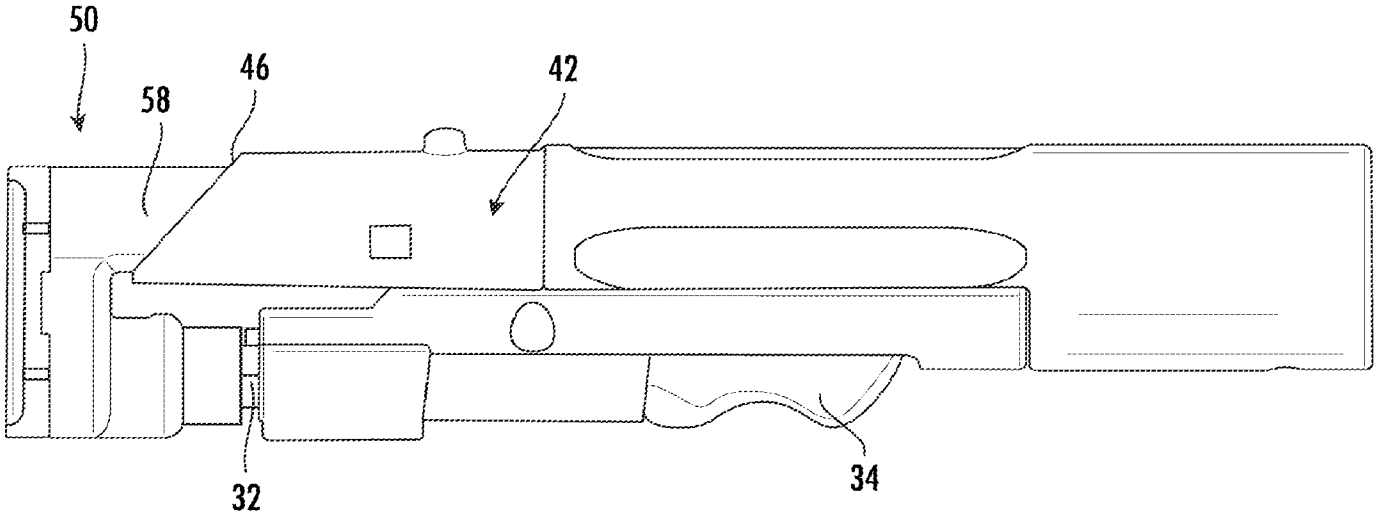
FIG. 4*b* is a side view of the cleaning accessory and the tool of FIG. 4*a* with the tool attached to the cleaning accessory.

Referring to FIGS. 2 and 3, the cleaning accessory 20 includes a nozzle 24 selectively removable from the suction duct 42 between an attached position (FIG. 2) and a removed position (FIG. 3). The nozzle 24 is configured to engage a surface to be cleaned. In the illustrated embodiment, the nozzle 24 is removably coupled to the suction duct 42 by a latch 26, but in other embodiments is removably coupled by a snap-fit, friction fit, bayonet lock, or the like. The suction duct 42 includes a suction inlet aperture 46. When the nozzle 24 is in the attached position, the suction inlet 22 is connected to the suction inlet aperture 46. The suction duct 42 further includes a sidewall 44 around and forming the suction inlet aperture 46. As further described below, the surface cleaner 10 further includes a tool 50 selectively connectable to the surface cleaner 10 configured to direct dispensed fluid from the supply tank 30 to the suction duct 42 for rinsing dirt and debris from interior portions of the sidewall 44 of the suction duct 42. In order to attach the tool 50, the nozzle 24 is removed from the suction duct 42, as shown in FIG. 3.

The surface cleaner 10 further includes an actuator 38 to selectively dispense fluid from the supply tank 30 through the fluid distributor 32. The actuator 38 can include a manually operated valve or a part of an automated system that is actuated by a microcontroller or other automated actuator. In the embodiment illustrated in FIGS. 2-10, the actuator 38 includes a manually operated valve 37 controlled by a trigger 34 that is user actuated. In response to a user actuating the trigger 34, the valve 37 is opened allowing fluid from the supply tank 30 to be dispensed through the fluid distributor 32. The fluid distributor 32 is connected to the supply tank 30 by a tube or duct 39.

Figure 5:
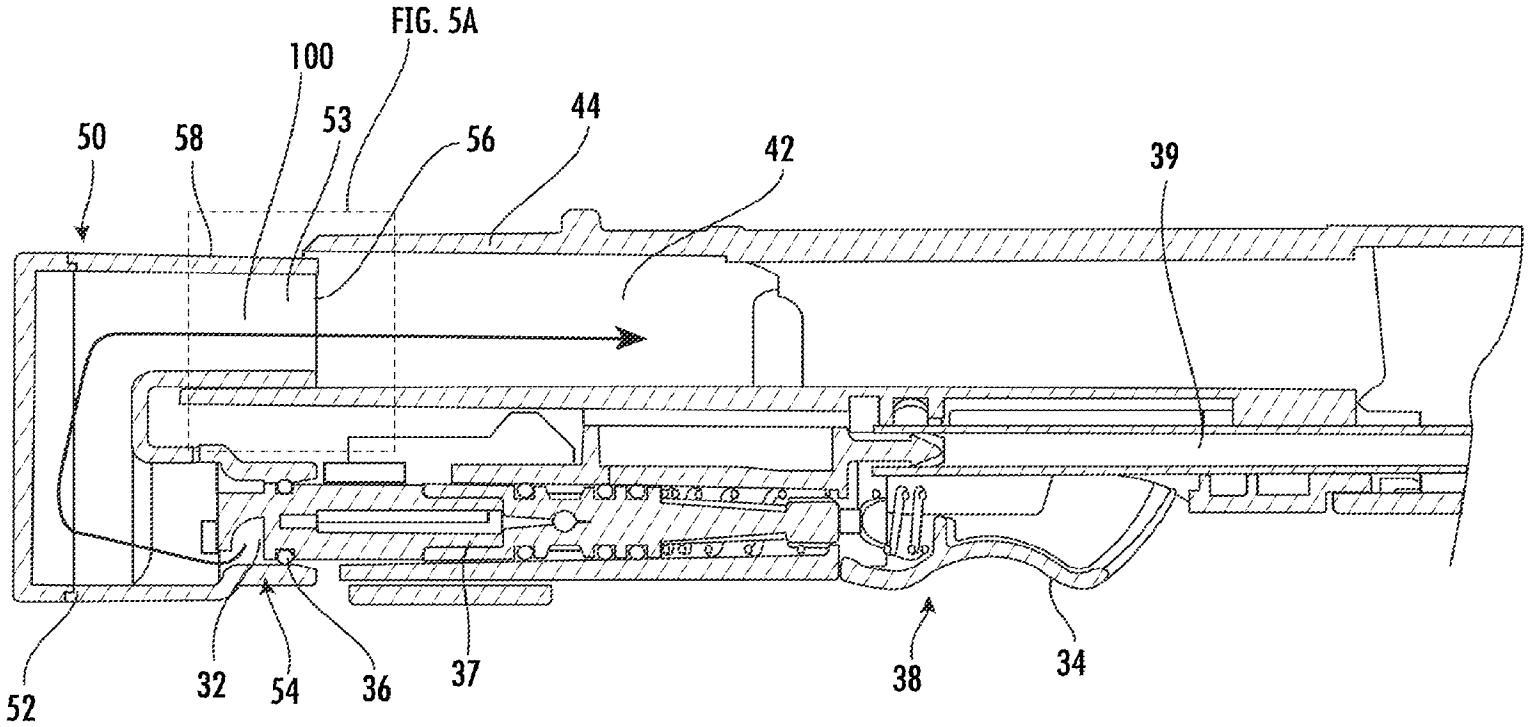
FIG. 5 is a cross-sectional view of the cleaning accessory and the attached tool of FIG. 4.
Figure 5A:
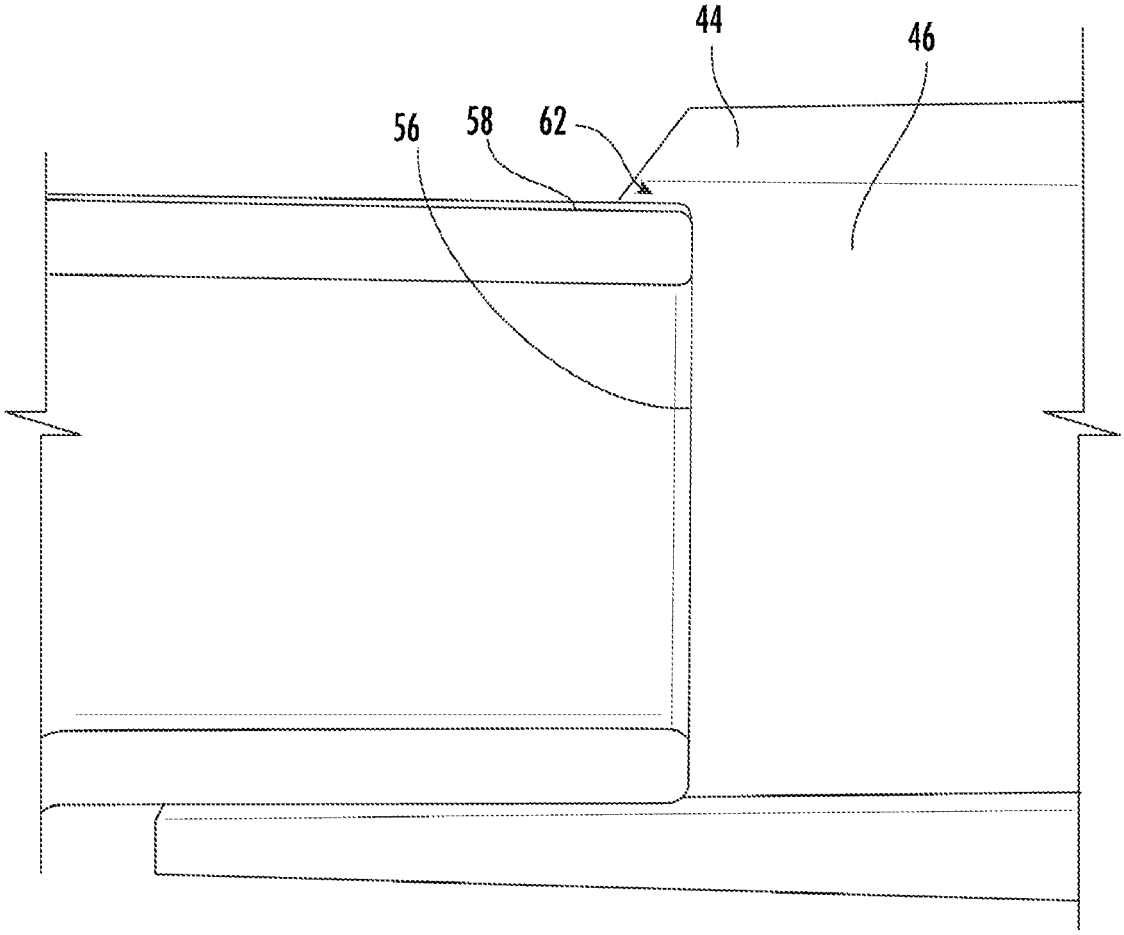
FIG. 5*a* is a detail view of the cleaning accessory and the attached tool of FIG. 5.
Figure 5B:
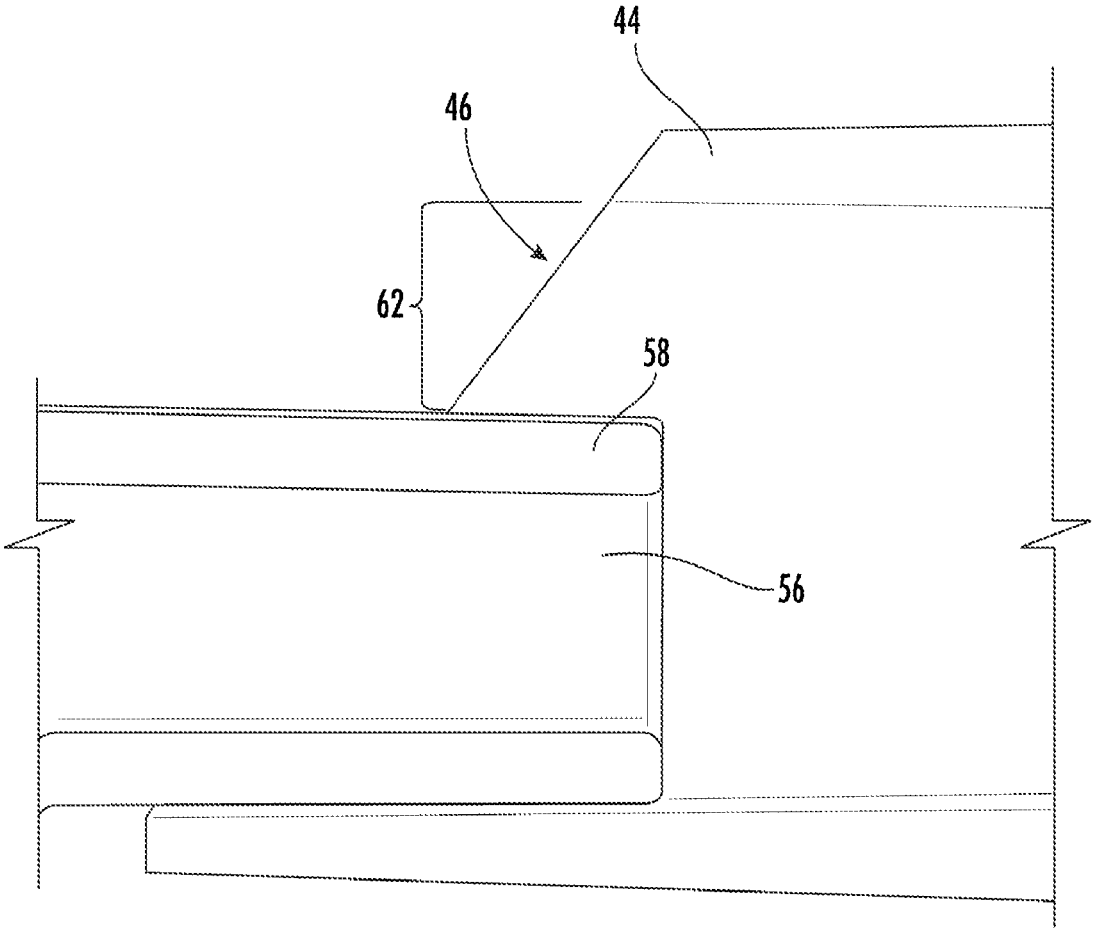
FIG. 5*b* is a detail view of the cleaning accessory and an attached tool, according to an alternative embodiment.
Figure 6:
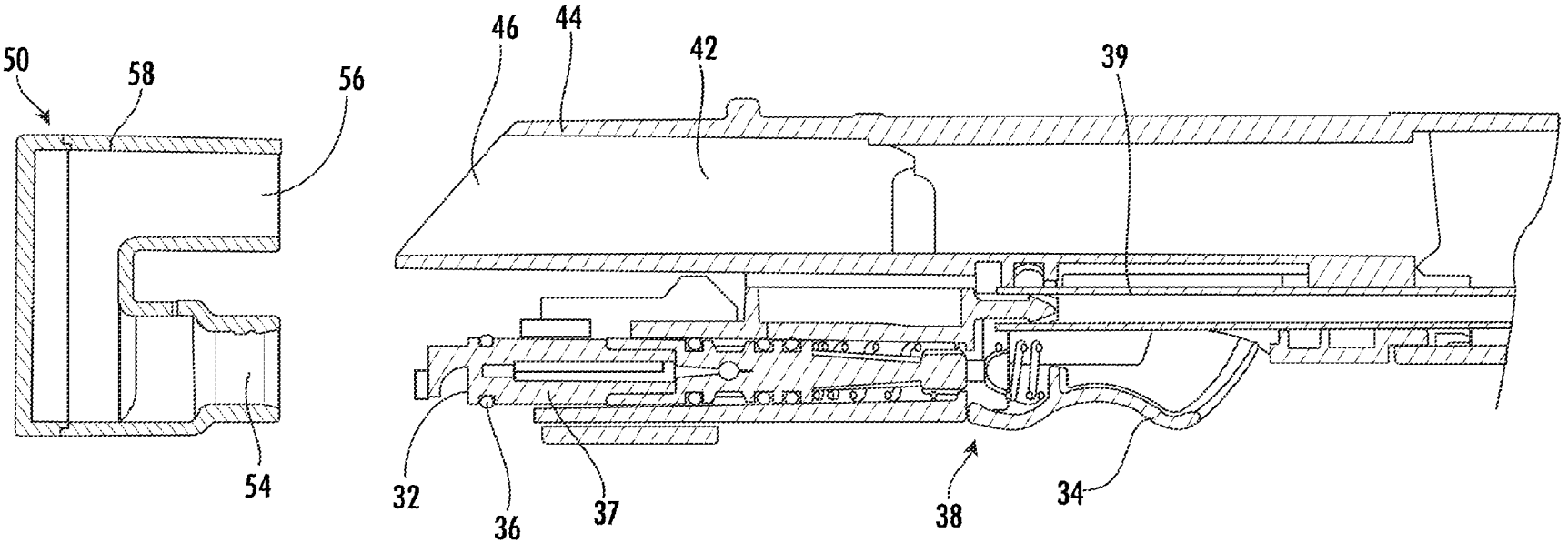
FIG. 6 is a cross-sectional view of the cleaning accessory of FIG. 4*a* with an exploded tool.
Figure 7:
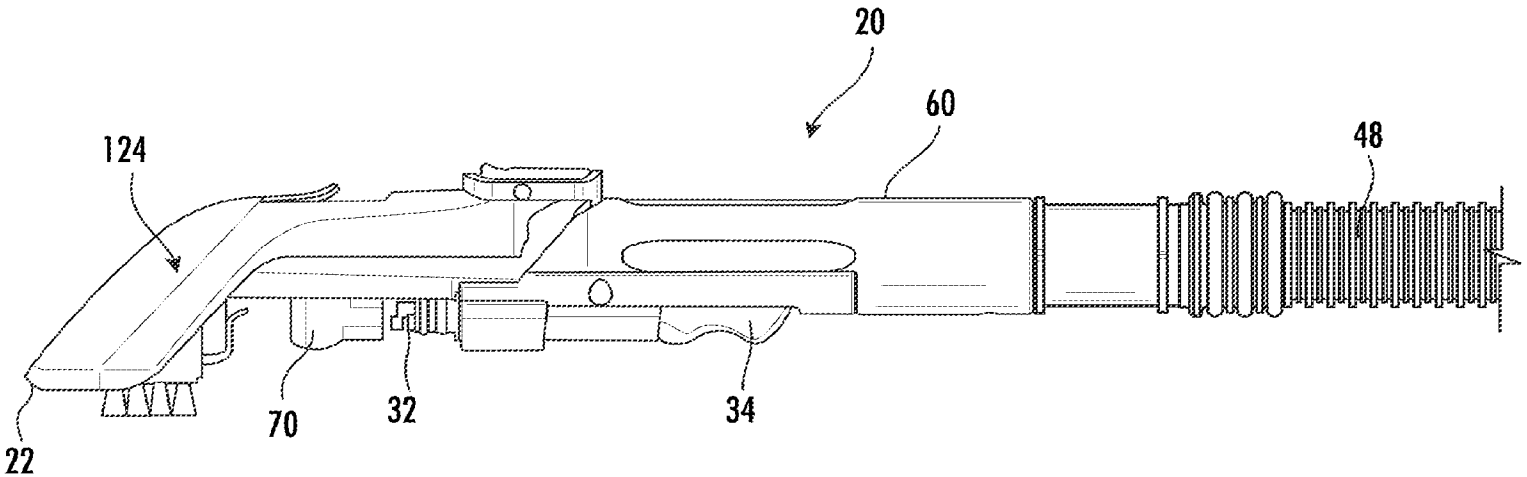
FIG. 7 is a side view of a cleaning accessory of the surface cleaner of FIG. 1 with a cover portion in a first position, according to an alternative embodiment.

As illustrated in FIG. 5, the tool 50 includes a housing 52 forming a passageway 53 between the fluid distributor 32 and the suction duct 42. The passageway 53 includes a passageway inlet 54 configured to receive a portion of the fluid distributor 32 and a passageway outlet 56 that is received in the suction duct 42. In the illustrated embodiment, the passageway outlet 56 includes an extension 58. The extension 58 may include a tubular portion with a wall. The passageway inlet 54 is configured to receive a portion of the fluid distributor 32 such that fluid dispensed from the fluid distributor 32 is dispensed into the passageway 53. The passageway outlet 56 is positionable within the suction inlet aperture 46 when the passageway inlet 54 receives a portion of the fluid distributor 32. As illustrated, the passageway outlet 56 slides into the end of the suction duct 42 such that the passageway outlet 56 directs dispensed fluid from the passageway 53 into the suction duct 42 (as indicated by arrow 100). In the embodiment illustrated in FIGS. 5*a* and 5*b*, the extension 58 of the passageway outlet 56 is spaced from the duct sidewall 44 inside the suction inlet aperture 46 by a gap 62. The gap 62 enables airflow into the suction inlet aperture 46 sufficient to draw fluid into the suction duct 42 from the fluid distributor 32 through the passageway 53. Stated another way, the extension 58 does not fill the entire suction inlet aperture 46, instead the gap 62 is provided between the extension 58 and the duct sidewall 44 inside of the suction inlet aperture 46 such that air flows into the suction inlet aperture 46 through the gap.

In the embodiment illustrated in FIGS. 1, 4*a*, 4*b*, 5, and 6, the tool 50 is movable between an attached position (FIGS. 4*b* and 5) wherein the tool 50 is attached to the suction duct 42 and the fluid distributor 32 and a removed position (FIGS. 1, 4*a*, and 6) wherein the tool 50 is spaced from the suction duct 42 and the fluid distributor 32. In the embodiment illustrated in FIG. 1, the tool 50 may have an onboard storage position to be stowed when in the removed position. As discussed above, in the attached position the passageway inlet 54 is positioned to receive a portion of the fluid distributor 32 and direct dispensed fluid along the passageway 53 to the suction duct 42 in order to rinse the suction duct 42 of dirt, debris, and potential clogs. The passageway outlet 56 is positioned within the suction inlet aperture 46 in the attached position. The passageway outlet 56 position inside of the suction inlet aperture 46 reduces the likelihood of fluid leaking from the tool 50 in use during cleaning of the suction duct 42 and suction inlet aperture 46.

In one embodiment, the tool 50 sealing engages the fluid distributor 32 when coupled. In one embodiment, an outer surface of the fluid distributor 32 is sized to be in tight fit sealing engagement with an inner surface of the passageway inlet 54 to inhibit dispensed fluid from leaking from the tool 50. In the illustrated embodiments (e.g., FIGS. 5 and 6), the fluid distributor 32 includes a sealing portion 36, such as an o-ring, a gasket, or a tight fit sealing engagement, in communication with the passageway inlet 54 of the tool 50. When the tool 50 is in the attached position (FIG. 5) the sealing portion 36 is positioned to engage and seal the passageway inlet 54 of the tool 50 to inhibit fluid egress from the tool 50 before the fluid reaches the suction duct 42.

In another embodiment, the passageway inlet 54 includes a sealing portion, such as an o-ring, a gasket, or a tight fit sealing engagement, positioned to sealingly engage the fluid distributor 32 in the attached position. In the illustrated embodiment, the fluid distributor 32 includes an o-ring sealing portion 36, and the engagement between the fluid distributor 32 and the passageway inlet 54 includes a friction fit sufficient to retain the tool 50 onto the cleaning accessory. In one embodiment (not shown) the tool is retained onto the cleaning accessory by a latch or other mechanical coupling.

Figure 1A:
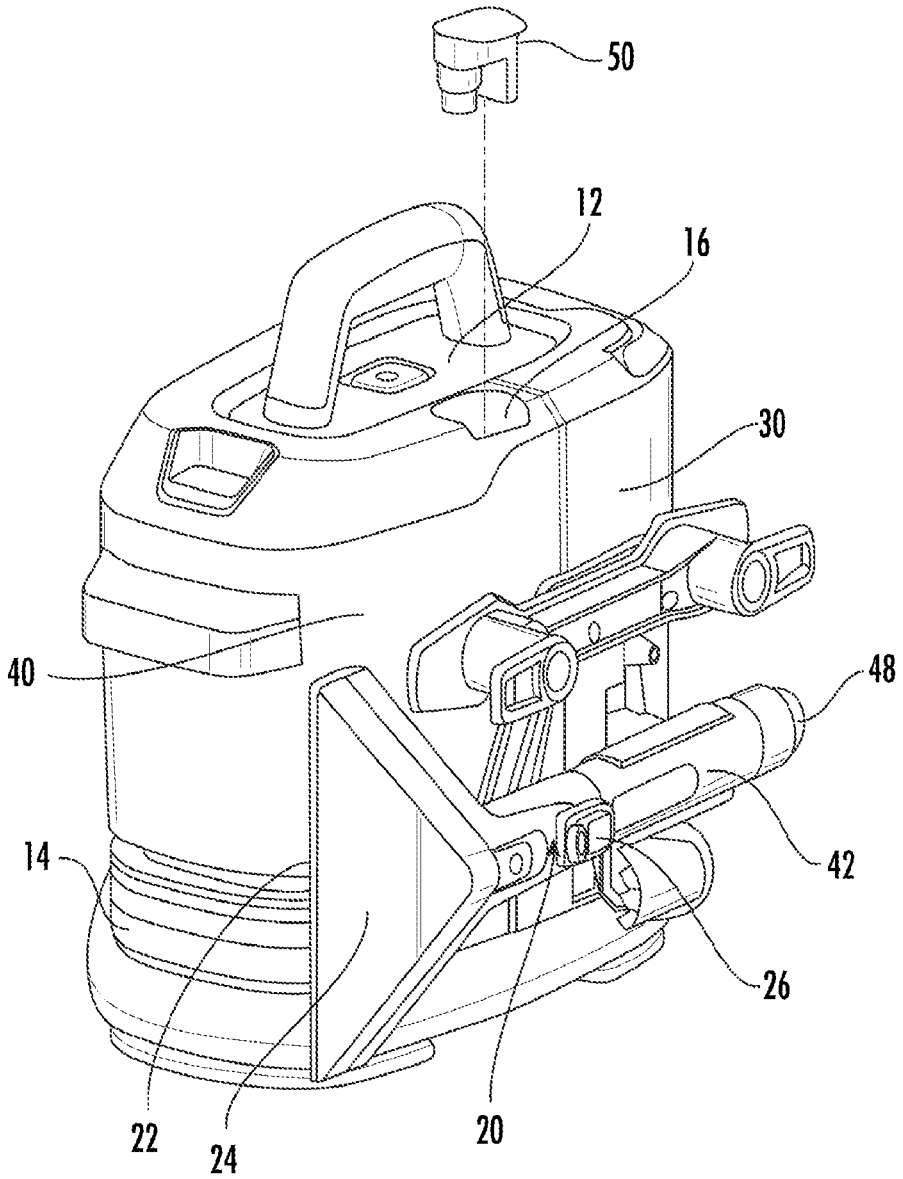
FIG. 1*a* is the surface cleaner of FIG. 1, with an exploded view of a tool.

In the embodiment illustrated in FIG. 1*a*, the recovery tank 40 includes a recessed portion 16. The recess 16 is sized to receive the tool 50 for onboard storage when the tool 50 is in the removed position. In another embodiment, the main body 12 of the surface cleaner includes a recess sized to receive the tool 50 for onboard storage. When the tool 50 is removed from the attached position, the user can place the tool 50 in the recess of the main body for secure storage. The tool 50 is sized such that when in the storage position, the tool has a similar profile to the rest of the main body 12, creating an efficient and aesthetically pleasing appearance.

In one embodiment, the fluid distributor 32 is disposed adjacent the suction inlet aperture 46. This arrangement allows the size of the tool 50 to be reduced, as well as reducing the length required for the passageway 53 through the tool 50. The reduced size of the tool 50 results in a more simple and cost efficient tool.

In the embodiment illustrated in FIGS. 1 and 1*a*, includes a wand 60 and a hose 48. The suction duct 42 extends through the wand 60 and the hose 48. The hose 48 connects the cleaning accessory 20 to the recovery tank 40. In one embodiment, the cleaner and the suction duct 42 are configured without the hose 48. In another embodiment, the distal end of the hose 48 is the suction duct and the suction inlet aperture 46 is formed by the end of the hose 48.

In the illustrated embodiment, the suction inlet aperture 46 is formed at the end of the suction duct 42. The duct sidewall 44 forms a perimeter of the suction inlet aperture 46. When the tool 50 is in the attached position, the extension 58 is positioned to be spaced from the duct sidewall 44 by the gap 62. In one embodiment, the extension 58 is spaced from the duct sidewall 44 around at least 20% of the perimeter of the suction inlet aperture 46. In another embodiment, the extension 58 is spaced from the duct sidewall 44 around at least 30% of the perimeter of the suction inlet aperture 46. In another embodiment, the extension 58 is spaced from the duct sidewall 44 around at least 40% of the perimeter of the suction inlet aperture 46, or at least 50% of the perimeter of the suction inlet aperture 46. In another embodiment, the extension 58 is spaced from the duct sidewall 44 around substantially all of the perimeter of the suction inlet aperture 46. The gap provided in the space between the extension 58 and the duct sidewall 44 enables airflow into the suction inlet aperture 46 sufficient to draw fluid into the suction duct 42 from the fluid distributor 32 through the passageway 53. In one embodiment, the gap 62 provides an area between 3% and 10% of the cross-sectional area of the suction duct 42 adjacent the extension 58. In one embodiment, the gap 62 provides and area between 5% and 25% of the cross-sectional area of the suction duct 42 adjacent the extension 58. In one embodiment, the gap 62 provides an area greater than 25% of the cross-sectional area of the suction duct 42 adjacent the extension 58.

In an alternate embodiment illustrated in FIGS. 7-10, the cleaning accessory 20 includes a nozzle 124 attachable to the suction duct 42 providing the suction inlet 22. When the nozzle 124 is in the attached position, the suction inlet 22 is connected to the suction inlet aperture 46 by a nozzle passageway 126. In this embodiment, the cleaning accessory 20 includes a mechanism to selectively direct fluid dispensed from the supply tank 30 to the suction duct 42 for rinsing dirt and debris from interior portions of the sidewall 44 of the suction duct 42. The mechanism to selectively direct fluid includes a cover portion 70 disposed on the nozzle 124 movable between a first position (FIGS. 7, 9, and 9*a*) wherein the cover portion 70 is in a stowed position and the cleaning accessory 20 is operational, and a second position (FIGS. 8, 10, and 10*a*) wherein the cover portion 70 is configured to direct fluid into the suction duct 42 for rinsing the suction duct 42. The cover portion 70 is coupled to the nozzle 124 adjacent the fluid distributor 32 slidable between the first position and the second position. The cover portion 70 includes an inlet aperture 72 configured to receive a portion of the fluid distributor 32 in the second position, an outlet aperture 74 distal the fluid distributor 32, and a cover pathway 76 connecting the inlet aperture 72 and the outlet aperture 74.

Figure 9:
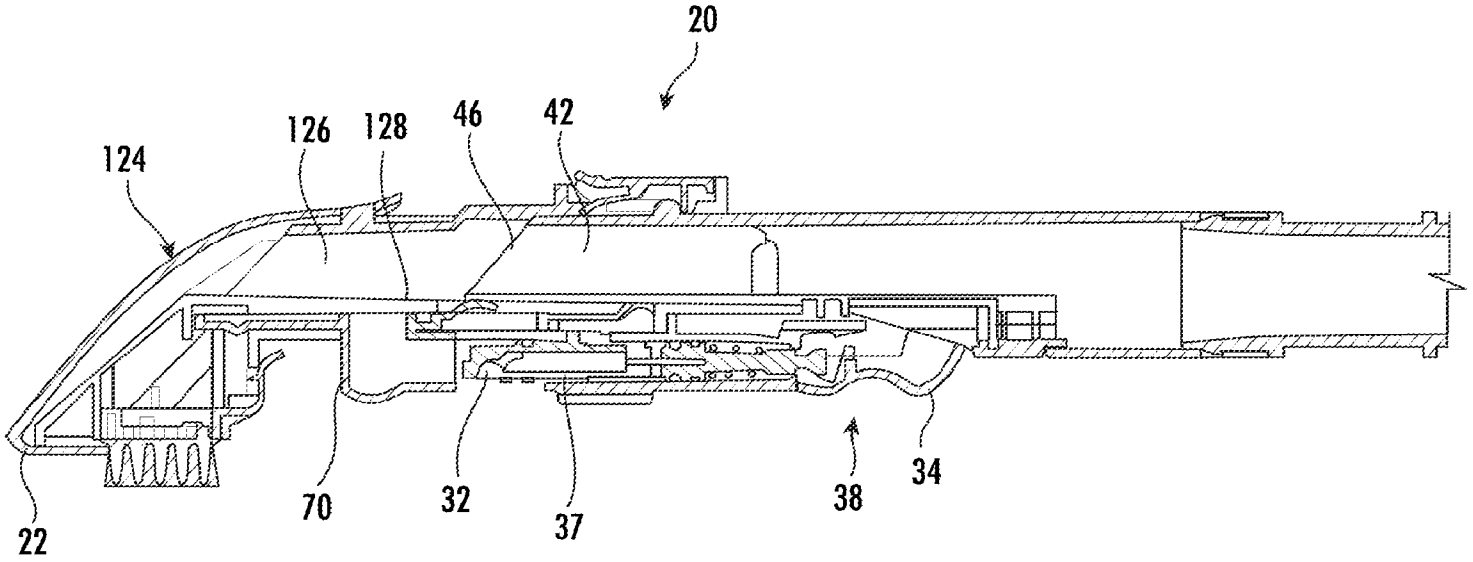
FIG. 9 is a cross-sectional view of the cleaning accessory of FIG. 7.
Figure 9A:
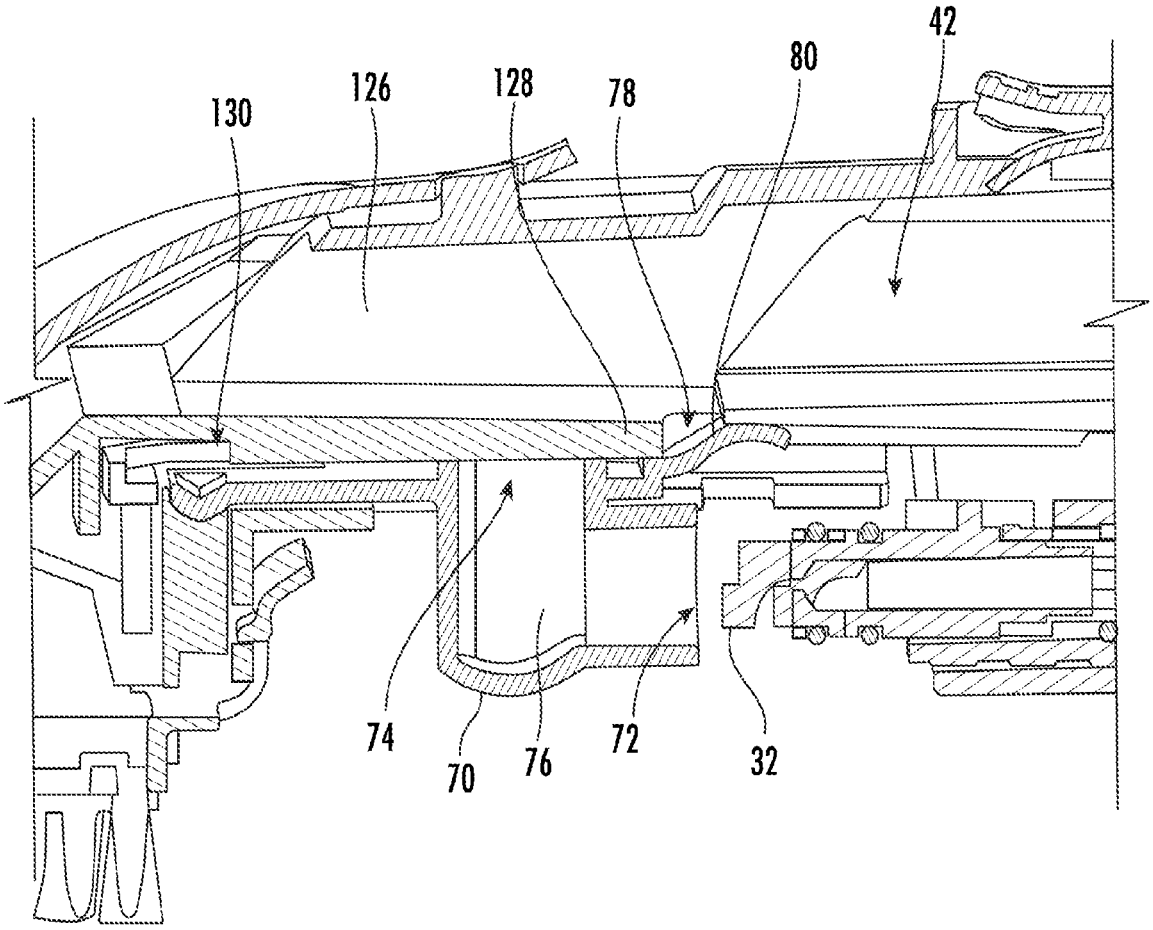
FIG. 9*a* is a detail view of the cleaning accessory of FIG. 9.

The nozzle 124 includes an aperture forming a fluid passageway 78 through a nozzle sidewall 128 to selectively permit fluid and air flow through the fluid passageway 78 into the nozzle passageway 126. When the cover 70 is in the second position, the outlet aperture 74 is aligned with the fluid passageway 78 connecting the cover pathway 76 with the nozzle passageway 126 to the suction duct 42. As illustrated in FIG. 9*a*, the cover portion 70 further includes a closure 80 configured to block the fluid passageway 78 when the cover portion 70 is in the first position inhibiting airflow through the fluid passageway 78 to the suction duct 42. The closure 80 is movable with the cover portion 70 such that the closure 80 blocks the fluid passageway 78 when the cover portion 70 is in the first position and opens the fluid passageway 78 when the cover portion 70 is in the second position.

Figure 8:
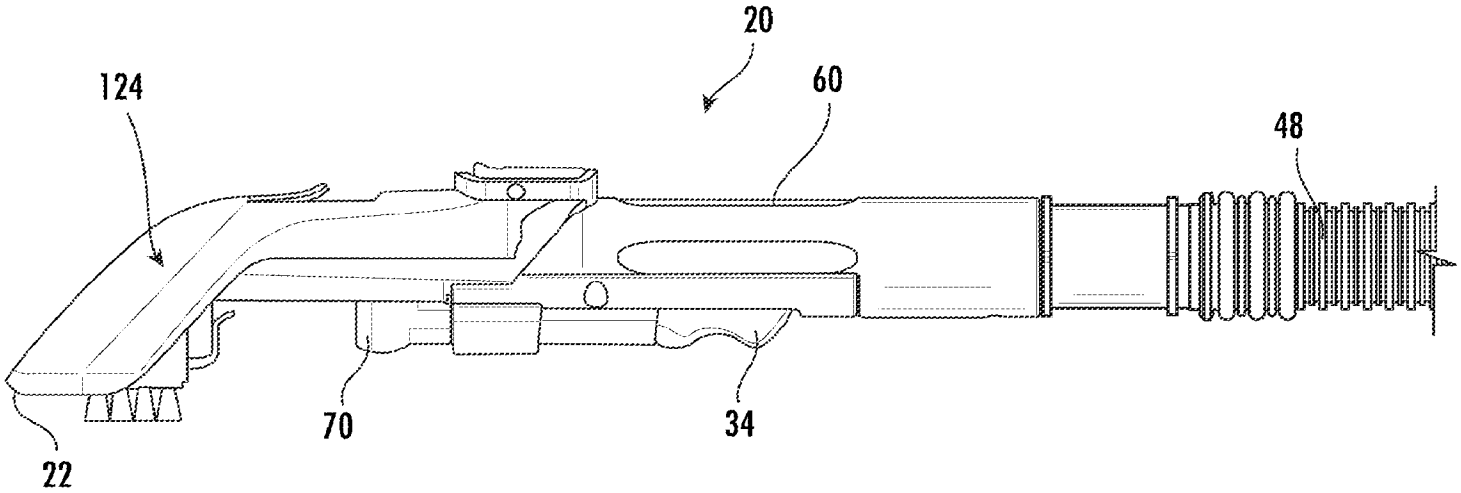
FIG. 8 is a side view of a cleaning accessory of FIG. 7 with a cover portion in a second position, according to one embodiment
Figure 10:
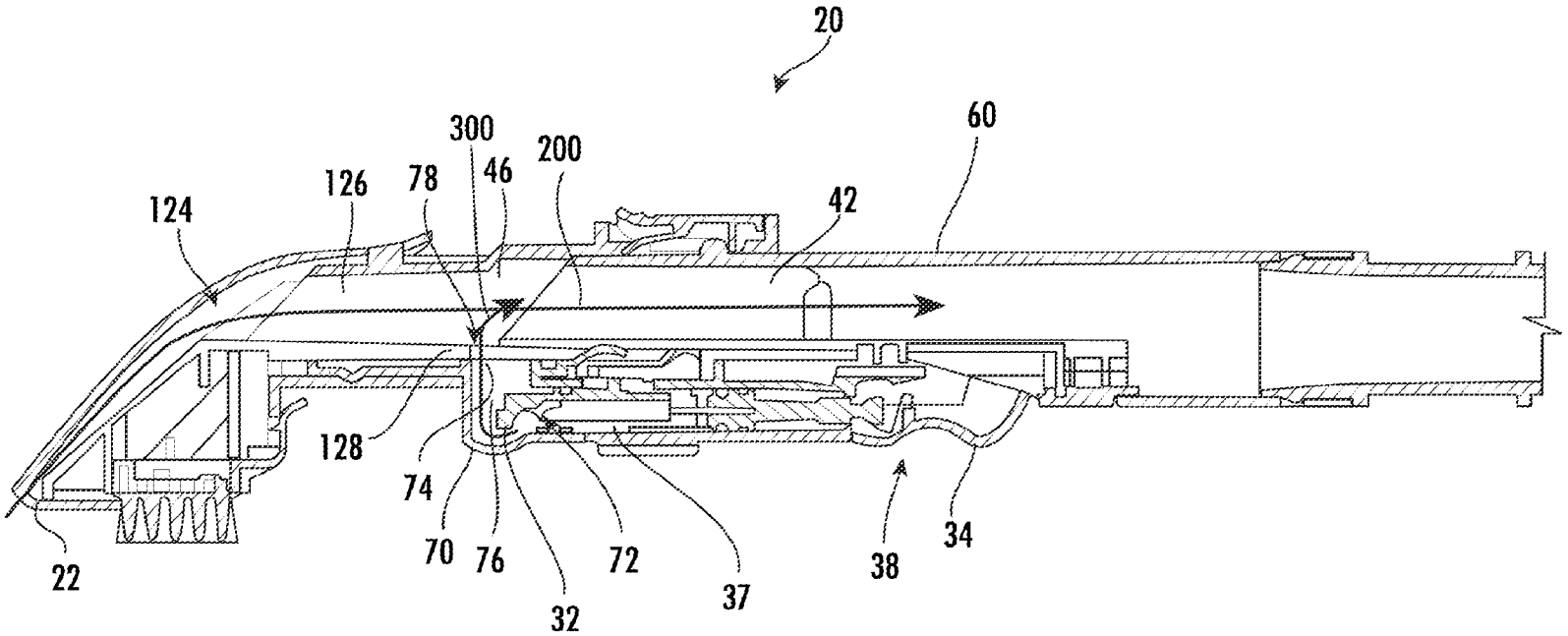
FIG. 10 is a cross-sectional view of the cleaning accessory of FIG. 8.
Figure 10A:
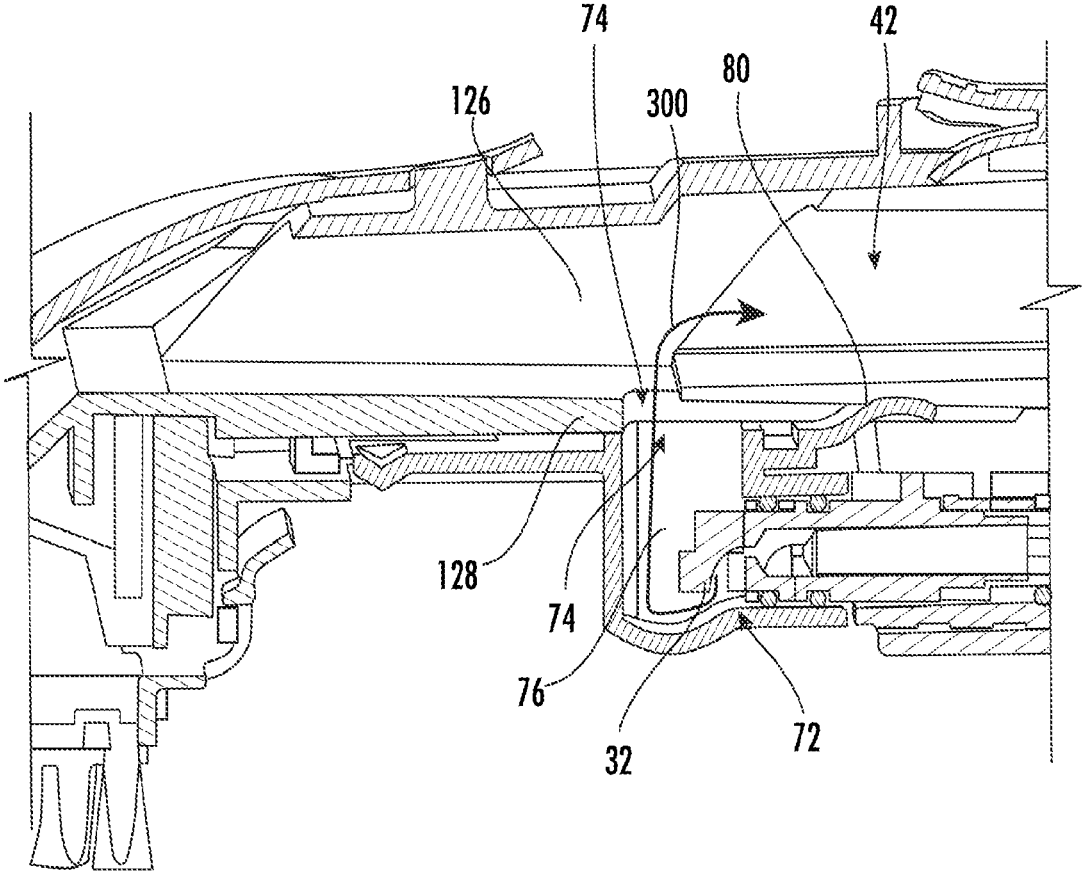
FIG. 10*a* is a detail view of the cleaning accessory of FIG. 10.

The cover portion 70 is movable between the first position (FIGS. 7, 9, and 9*a*) and the second position (FIGS. 8, 10, and 10*a*). In the first position the fluid distributor 32 dispenses fluid outwardly away from the cleaning accessory 20 and in the second position the fluid distributor 32 dispenses fluid into the cover portion 70. In the first position, the cleaning accessory 20 is operational with the cover inlet aperture 72 spaced from and enabling the fluid distributor 32, and the closure 80 blocking the fluid passageway inhibiting airflow through the fluid passageway 78 into the nozzle passageway 126. In the second position, the cover inlet aperture 72 is positioned over the fluid distributor 32 and the outlet aperture 74 is aligned with the fluid passageway 78 to enable fluid dispensed from the fluid distributor 32 to flow through the cover pathway 76 (as indicated by arrow 300), through the outlet aperture 74 and the fluid passageway 78, into the nozzle passageway 126 and into the suction duct 42. Airflow through the nozzle inlet 22 along the nozzle passageway 126 (as indicated by arrow 200) draws dispensed fluid into the suction duct 42 from the fluid distributor 32 through the fluid passageway 78. This embodiment provides a cover that is selectively able to divert fluid to clean the suction duct 42 and is integral with the nozzle 124.

In the illustrated embodiment, the cover portion 70 is slidable along a T-slot 130 between the first position and the second position. The cover portion 70 is coupled to the nozzle 124, but in other embodiments may be slidably coupled to another portion of the surface cleaner, such as the suction duct 42. In one embodiment, the cover portion 70 includes rails and the nozzle 124 includes a track corresponding to the rails to allow the cover portion 70 to slide on the rails between the first position and the second position. In another embodiment, the cover portion 70 includes a track and the nozzle 124 includes rails corresponding to the track to allow the cover portion to slide on the track between the first position and the second position.

Figure 11:
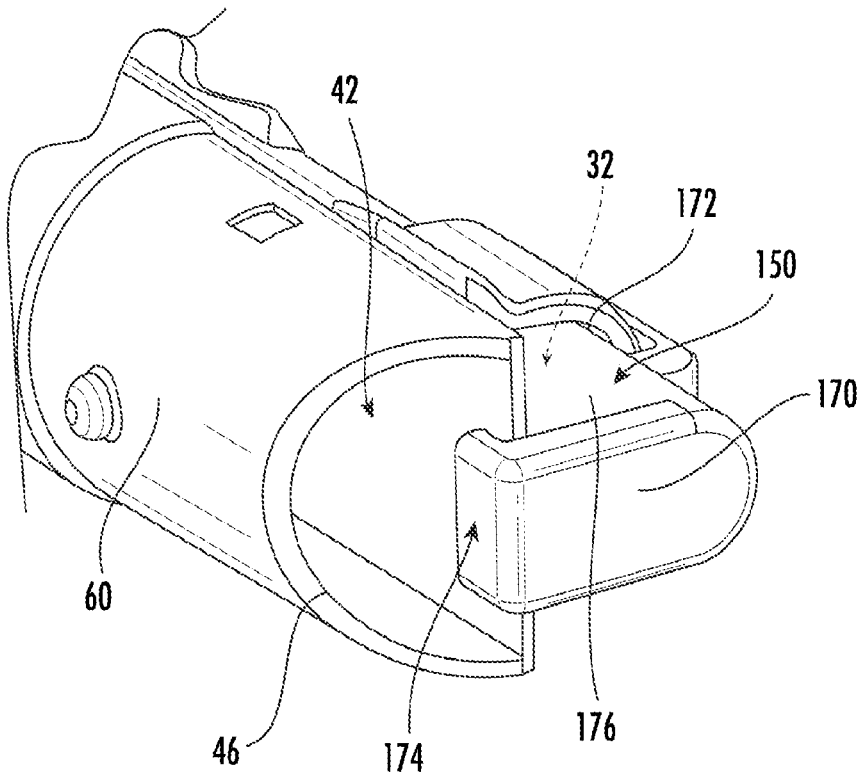
FIG. 11 is a perspective view of a cleaning accessory of the surface cleaner of FIG. 1 and an alternative attached tool, according to one embodiment.
Figure 12:
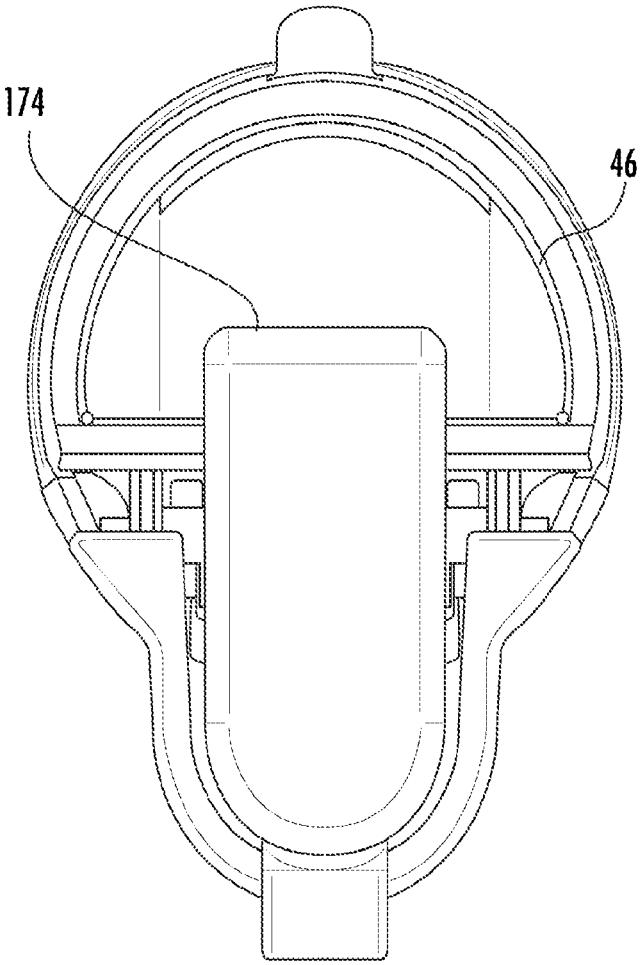
FIG. 12 is an end view of the cleaning accessory and the attached tool of FIG. 11.

In another alternate embodiment illustrated in FIGS. 11 and 12, the surface cleaner 10 includes an alternative tool 150 selectively connectable to the surface cleaner 10 configured to direct dispensed fluid from the supply tank 30 to the suction duct 42 for rinsing dirt and debris from interior portions of the sidewall 44 of the suction duct 42. Specifically, in the illustrated embodiment, the tool 150 is connectable to the fluid distributor 32 adjacent the suction inlet aperture 46. The tool 150 forms a removable cover portion 170 positionable over the fluid distributor 32 in a coupled position. The cover portion 170 includes a housing 176 having a fluid inlet 172 and a fluid outlet 174 configured to direct fluid flow from the fluid inlet 172 to the suction inlet aperture 46. The cover fluid inlet 172 is configured to be positionable over the fluid distributor 32 in a coupled position. The cover portion 170 directs fluid dispensed from the fluid distributor 32 through the cover portion 170, and out the fluid outlet 174. The outlet 174 is positioned to direct the received fluid toward or into the suction inlet aperture 46.

In one embodiment, the tool 150 sealing engages the fluid distributor 32 when coupled. When the tool 150 is coupled to the fluid distributor 32, the fluid inlet 172 sealing engages the fluid distributor 32 to inhibit fluid egress from the tool 150 before the fluid reaches the fluid outlet 174. In one embodiment, the tool 150 is connectable to the fluid distributor 32 by a friction fit engagement between the fluid distributor 32 and the fluid inlet 172 sufficient to retain the tool 150 onto the fluid distributor 32.

In the illustrated embodiment, the tool 150 including the fluid outlet 174 is positioned adjacent the suction duct 42 such that the tool 150 covers less than 10% of the suction inlet aperture 46. In another embodiment, the tool 150 including the fluid outlet 174 is positioned adjacent the suction duct 42 such that the tool 150 covers less than 50% of the suction inlet aperture 46. The suction source 28 provides suction to draw the dispensed fluid through the suction inlet aperture 46 and into the recovery tank 40. Once cleaning of the suction inlet aperture 46 and the suction duct 42 is complete as desired, the user removes the cover portion 170 from the fluid distributor 32. In one embodiment, the outlet 174 is spaced from the suction inlet aperture 46 such that the outlet 174 does not contact the suction inlet aperture 46. In one embodiment, the outlet 174 is spaced from the suction inlet aperture 46 from 0 to 7 millimeters. In one embodiment, the outlet 174 is spaced from the suction inlet aperture 46 greater than 7 millimeters.

Various features and advantages of the invention are set forth in the following claims.

What is claimed is:

1. A surface cleaner comprising:

a supply tank configured to store a fluid;

a fluid distributor in fluid communication with the supply tank;

an actuator to selectively dispense the fluid from the supply tank through the fluid distributor;

a duct having sidewalls forming a suction inlet aperture;

a suction source in fluid communication with the suction inlet aperture;

a recovery tank in fluid communication with the suction inlet aperture and the suction source, the recovery tank configured to receive recovered fluid and debris drawn through the suction inlet aperture;

a tool selectively connectable to the surface cleaner configured to direct the fluid dispensed from the supply tank to the duct for rinsing the duct, the tool having a housing forming a passageway, the passageway having a passageway inlet configured to receive a portion of the fluid distributor; and a passageway outlet;

wherein the passageway outlet is positionable within the suction inlet aperture when the passageway inlet receives a portion of the fluid distributor; and wherein the passageway outlet of the tool is spaced from the duct sidewall inside the suction inlet aperture enabling airflow into the suction inlet aperture between the passageway outlet and the duct sidewall sufficient to draw dispensed fluid from the passageway into the duct when the actuator selectively dispenses fluid from the fluid dispenser into the passageway inlet.

2. The surface cleaner of claim 1, wherein the fluid distributor is disposed adjacent the suction inlet aperture.

3. The surface cleaner of claim 1, wherein the duct is disposed at an end of a hose.

4. The surface cleaner of claim 1, wherein the suction inlet aperture is formed at the end of the duct, the sidewalls of the duct forming a perimeter of the suction inlet aperture.

5. The surface cleaner of claim 1, further comprising a hose, wherein the hose includes the duct, and wherein the suction inlet aperture is formed by an end of the hose.

6. The surface cleaner of claim 1, wherein the passageway outlet of the tool is spaced from the duct sidewall around at least 40% of a perimeter of the suction inlet aperture.

7. The surface cleaner of claim 1, wherein the passageway outlet of the tool is spaced from the duct sidewall around substantially all of a perimeter of the suction inlet aperture.

8. The surface cleaner of claim 1, wherein the passageway outlet of the tool is spaced from the duct sidewall by a gap, wherein the gap provides an area between 3% and 10% of a cross-sectional area of the suction duct.

9. The surface cleaner of claim 1, wherein the tool is movable between an attached position where the passageway inlet is over the fluid distributor and the passageway outlet is within the suction inlet aperture and a removed position where the tool is spaced from the fluid distributor and the suction inlet aperture.

10. The surface cleaner of claim 1, where the surface cleaner includes a main body, the main body having a recessed portion, wherein the tool is storable in the recessed portion when the tool is in the removed position.

11. The surface cleaner of claim 1, where the recovery tank includes a recessed portion, wherein the tool is storable in the recessed portion when the tool is in the removed position.

12. The surface cleaner of claim 1, wherein the passageway inlet further includes a sealing portion to sealingly engage the fluid distributor in the attached position.

13. The surface cleaner of claim 1, wherein one of the tool passageway inlet and the fluid distributor further includes a sealing portion to sealingly engage the other of the tool passageway inlet and the fluid distributor in the attached position.

14. A surface cleaner comprising:

a suction source;

a suction duct having a suction inlet aperture in fluid communication with the suction source;

a supply tank configured to store a fluid;

a fluid distributor disposed adjacent the suction inlet aperture in fluid communication with the supply tank;

an actuator to selectively dispense the fluid from the supply tank through the fluid distributor;

a recovery tank in fluid communication with the suction inlet aperture and the suction source, the recovery tank configured to receive recovered fluid and debris drawn through the suction airflow from the suction inlet aperture;

a tool selectively connectable to the fluid distributor, the tool configured to direct the fluid dispensed from the supply tank to the suction duct to rinse the suction duct, the tool including a housing with a fluid inlet configured to receive a portion of the fluid distributor; and a fluid outlet configured to direct fluid flow from the fluid inlet to the suction inlet aperture, wherein the fluid outlet is positioned adjacent the suction inlet aperture and the tool covers less than 50% of the suction inlet.

15. The surface cleaner of claim 14, wherein the tool is movable between an attached position in which the tool is positioned over the fluid distributor and a removed position in which the tool is spaced from the fluid distributor.

16. The surface cleaner of claim 14, wherein the tool is connectable to the fluid distributor by a friction fit engagement between the fluid distributor and the fluid inlet sufficient to retain the tool onto the fluid distributor.

17. The surface cleaner of claim 14, wherein the outlet of the tool is spaced from the suction inlet aperture.

* * * * *